US005706614A

United States Patent [19]

Wiley, Jr. et al.

[11] Patent Number: 5,706,614

[45] Date of Patent: Jan. 13, 1998

[54] MODULAR BUILDING HAVING A STEEL SHIPPING CONTAINER CORE

[76] Inventors: James G. Wiley, Jr., P.O. Box 10929, Yakima, Wash. 98909; Steve Forney, 1011 Shuler Grade, Yakima, Wash. 98908

[21] Appl. No.: 731,683

[22] Filed: Oct. 16, 1996

[51] Int. Cl.[6] ..... E04B 1/348

[52] U.S. Cl. ..... 52/79.1; 52/79.9; 52/79.13; 52/537; 52/783.11; 52/783.19

[58] Field of Search ..... 52/79.1, 79.9, 52/79.13, 537, 783.11, 783.19

[56] References Cited

U.S. PATENT DOCUMENTS

| | | | |
|---|---|---|---|
| 410,294 | 9/1889 | Sagendorph | 52/537 X |
| 3,182,424 | 5/1965 | Betjemann . | |
| 3,188,131 | 6/1965 | Attwood | 52/537 X |
| 3,500,595 | 3/1970 | Bennett | 52/79.13 |
| 3,680,273 | 8/1972 | Bigelow, Jr. . | |
| 3,909,998 | 10/1975 | Simpson et al. | 52/537 X |
| 4,299,065 | 11/1981 | Fairgrieve | 52/79.13 X |
| 4,439,957 | 4/1984 | Raasakka et al. | 52/79.1 |
| 4,467,573 | 8/1984 | Langerbeck . | |
| 4,644,708 | 2/1987 | Baudot et al. | 52/79.9 |
| 4,854,094 | 8/1989 | Clark . | |
| 4,882,883 | 11/1989 | Horn | 52/79.1 |
| 5,193,325 | 3/1993 | Allison | 52/79.9 X |
| 5,317,857 | 6/1994 | Allison | 52/79.1 |
| 5,353,557 | 10/1994 | Lerner et al. | 52/79.1 X |

*Primary Examiner*—Wynn E. Wood
*Attorney, Agent, or Firm*—Brady, O'Boyle & Gates

[57] ABSTRACT

A modular building having a steel shipping container core. Inner and outer wall coverings are secured to the corrugated side walls of the container and a laminate ceiling structure is secured to the interior surface of the container roof. A roof cap having a configuration corresponding to the roof of the container is mounted on the roof of the container, and the floor of the container provides a subflooring for the finished flooring of the building.

8 Claims, 4 Drawing Sheets

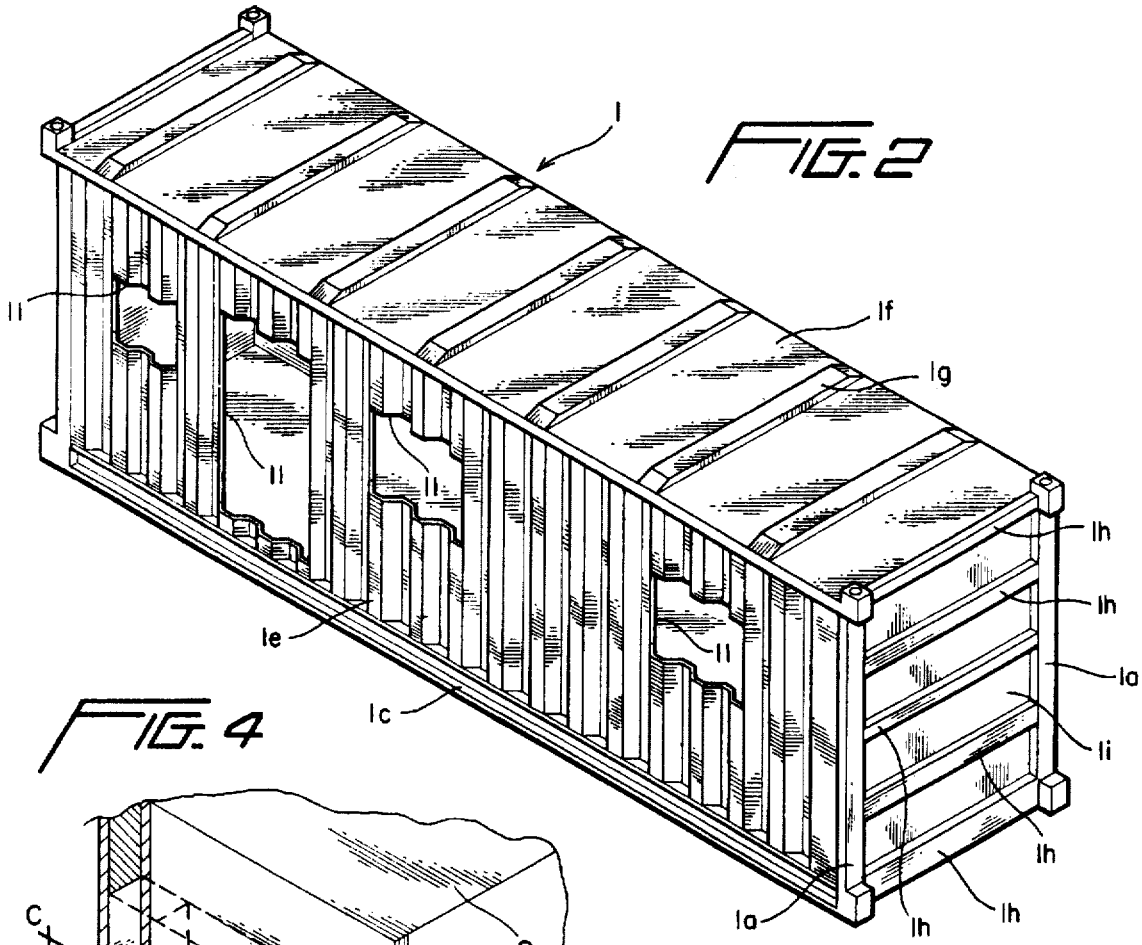
FIG. 2
FIG. 4
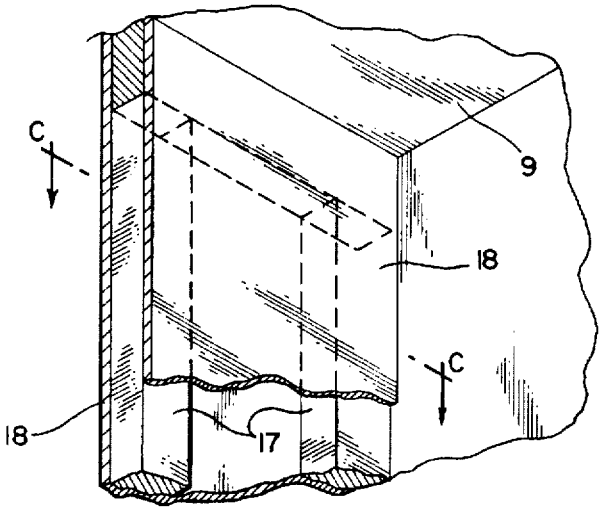
FIG. 5
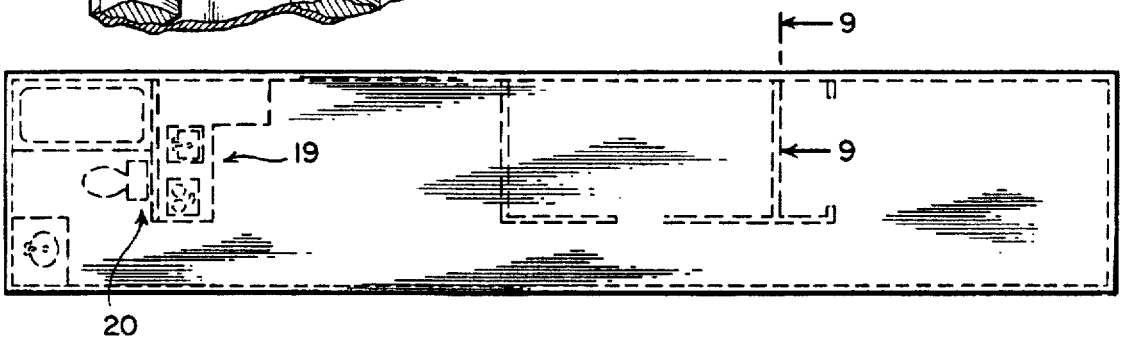

MODULAR BUILDING HAVING A STEEL SHIPPING CONTAINER CORE

BACKGROUND OF THE INVENTION

It is known to convert steel shipping containers, which have been taken out of service, into habitable buildings. Such an arrangement is disclosed in U.S. Pat. 4,854,094 dated Aug. 8, 1989. While the building disclosed in the aforementioned patent is satisfactory for its intended purpose, it is characterized by certain disadvantages in that it is not prefabricated but rather constructed at the building site which adds to the expense of the building. The buildings are also provided with peaked roofs which further adds to the expense of the building. Also, the spacers used to convert the interior ceiling and side walls to the inner surface of the container do not utilize the corrugated configuration of the steel container, thereby decreasing the interior dimension of the building. Furthermore, fasteners or connectors extend through predrilled holes for securing the outside covering and inside covering to the corrugated walls, thereby jeopardizing the insulating integrity of the building.

To overcome the disadvantages experienced with heretofore employed buildings having steel shipping container cores, the modular building of the present invention has been devised.

SUMMARY OF THE INVENTION

The building of the present invention comprises, essentially, a steel shipping container having corrugated side walls and a roof having reinforcing bosses extending transversely thereon. Vertically extending wood strips are adhesively secured within the groove portions of the corrugated side walls to provide studs to which a layer of inside insulation is secured. A weather resistant outside covering is secured to the peak portions of corrugated side walls, and an inside wall covering is secured to the layer of insulation. Transversely extending wood strips are positioned with and secured to the roof bosses to provide studs for securing a layer of ceiling insulation thereto to which an inside ceiling covering is secured. The exterior roof of the container is provided with a plastic roof cap molded to conform to the configuration of the container roof. Suitable prefabricated windows and a door are provided in openings cut in the walls of the container, and the interior of the container is provided with stud walls for dividing the floor space into various rooms such as a bathroom, kitchen, bedroom, etc.

The building of the present invention is prefabricated and then transported to the building site. During the fabrication of the building, the double steel doors of the container remain open to facilitate the interior finishing of the building including the installation of the plumbing fixtures after which the doors are welded shut to form an end wall of the building which is provided with an interior and exterior finish.

By prefabricating the building of the present invention, a less expensive building is provided. By positioning the wall wood strips in the groove portions of the corrugated side walls, and in the roof bosses, the interior dimensions of the building are not compromised, and by not employing mechanical fasteners for securing the interior and exterior walls to the corrugated walls of the container, the insulating integrity of the building is not jeopardized.

BRIEF DESCRIPTION OF THE DRAWINGS

FIG. 2 is a perspective view of the container shown in FIG. 1 having portions removed to provide a door and window openings;

FIG. 4 is a fragmentary perspective view of an interior corner;

FIG. 5 is a diagrammatic top plan view of the building;

DESCRIPTION OF THE PREFERRED EMBODIMENTS

Figure 1:
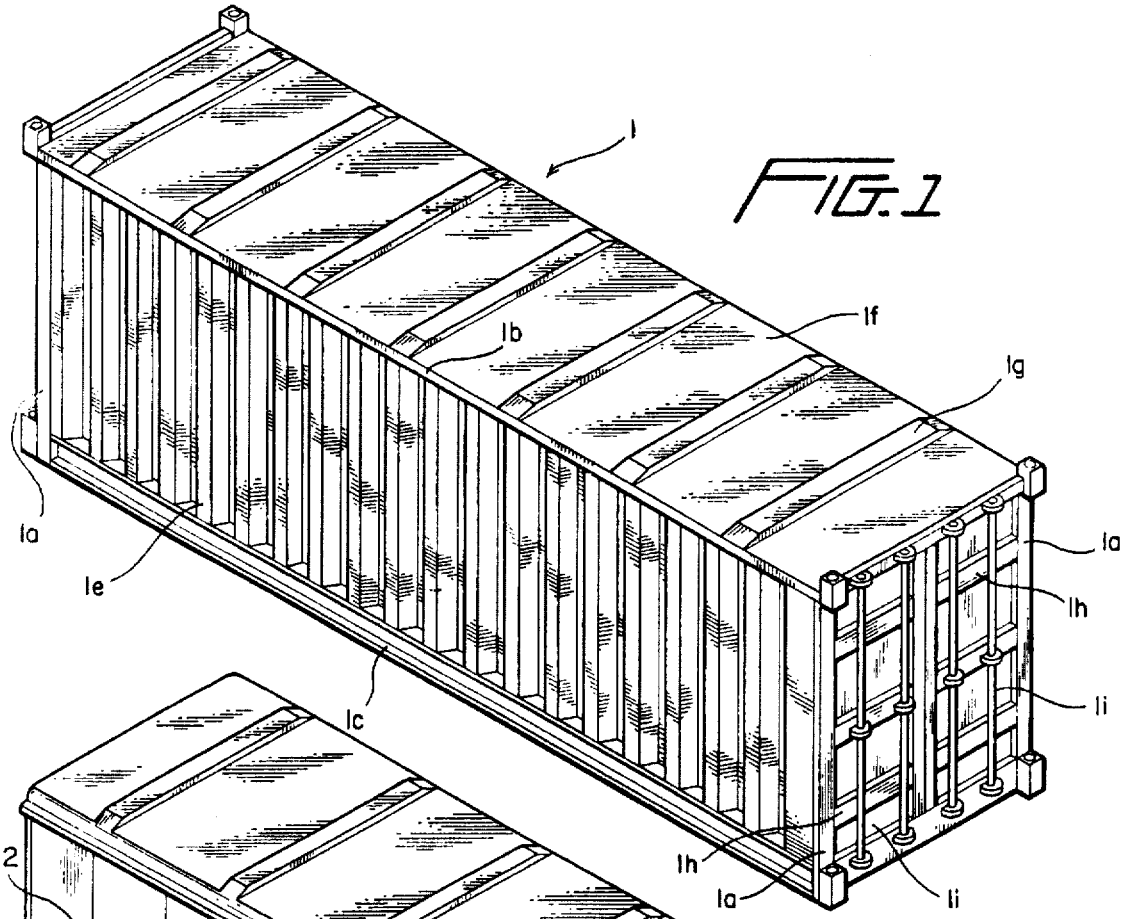
FIG. 1 is a perspective view of a conventional steel shipping container.

Referring to the drawings and more particularly to FIGS. 1, 2, 6, and 8, the conventional steel shipping container 1 providing the core for the modular building of the present invention includes vertically extending tubular members 1*a* at the four corners of the container and longitudinally extending tubular members 1*b* welded to the upper ends of the corner members 1*a*. Longitudinally extending channel members 1*c* are welded to the lower ends of the tubular members 1*a* to which the floor 1*d* of the container is secured. Corrugated side walls 1*e* are welded to the tubular members 1*b* and channel members 1*c*, and a roof if having reinforcing bosses 1*g* is welded to the longitudinally extending tubular members 1*b*. The end walls of the container are of similar construction and include transversely extending tubular members 1*b* welded at each end to a corner tubular member 1*a*. The end wall shown in FIG. 1 is constructed to provide hinged doors 1*i*, while the opposite end wall is fixed and includes a steel sheet 1*j* welded to the transversely extending tubular members 1*h*.

Figure 9:
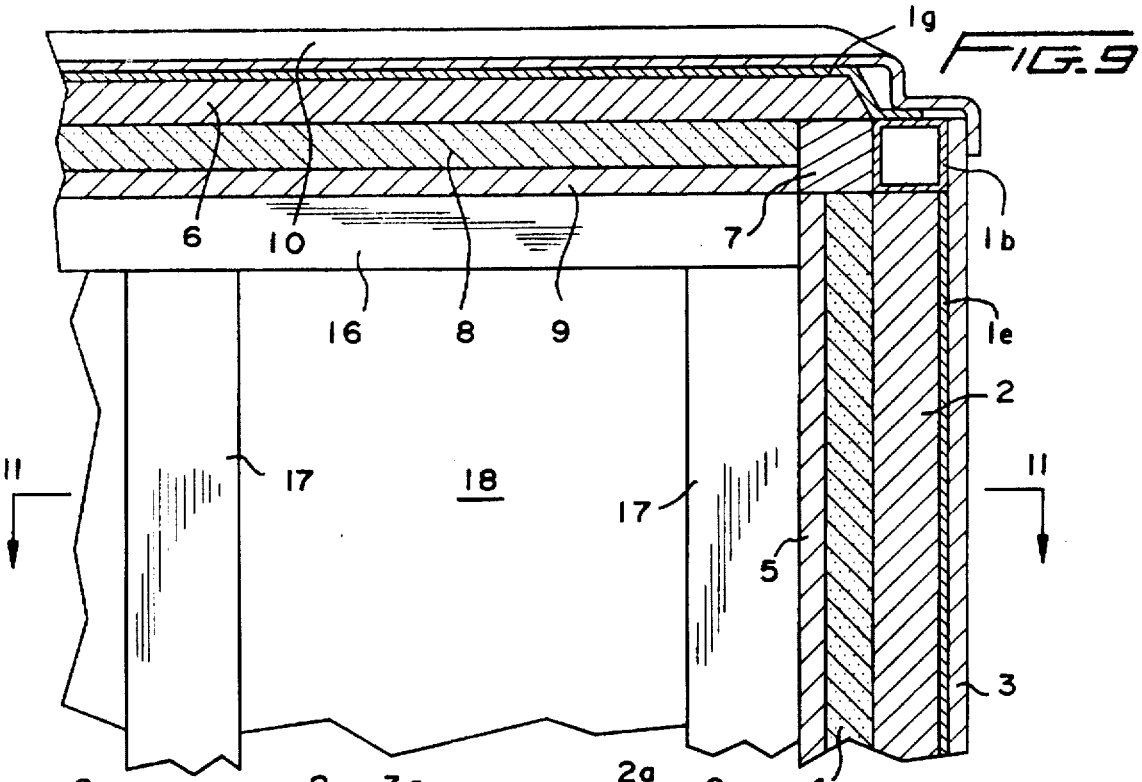
FIG. 9 is a view along line 9—9 of FIG. 5.
Figure 10:
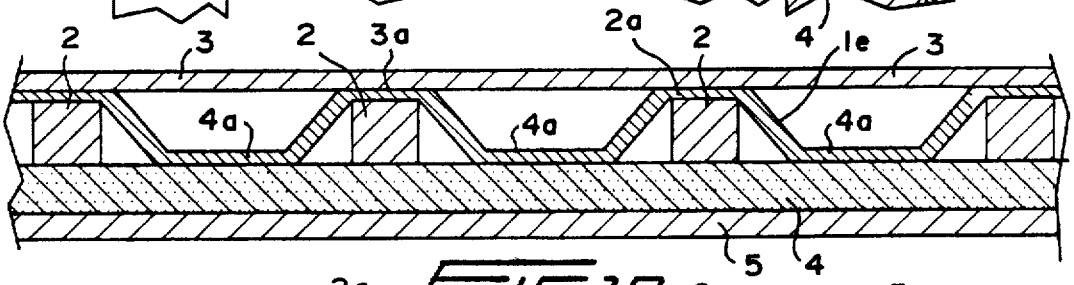
FIG. 10 is a view taken along line 10—10 of FIG. 3.
Figure 11:
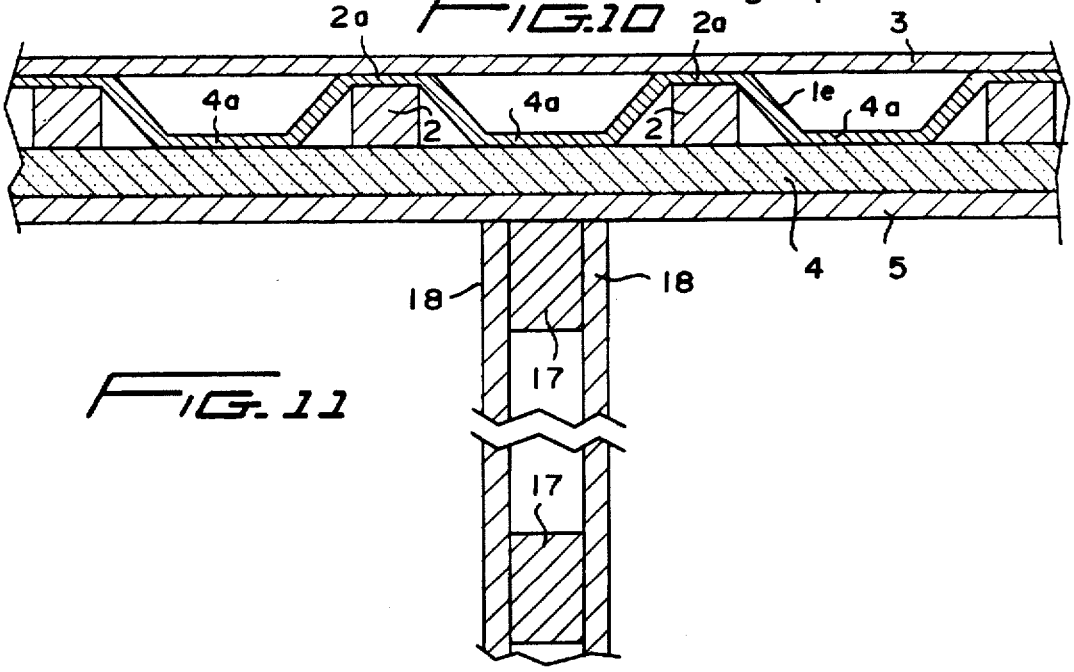
FIG. 11 is a view taken along line 11—11 of FIG. 9.

As will be seen in FIGS. 9 and 10 vertically extending wooden strips 2 are adhesively secured within the inwardly facing groove portions 2*a* of the corrugated side walls 1*e*. An exterior wall covering 3 is adhesively secured to the outwardly facing peak portions 3*d* of the corrugated side walls 1*e*. A layer of insulation 4 is secured to the wood strips 2 and to the inwardly facing peak portions 4*a* of the corrugated side walls 1*e*. An inside wall covering 5 is applied to the inner surface of the insulation layer 4.

Figure 6:
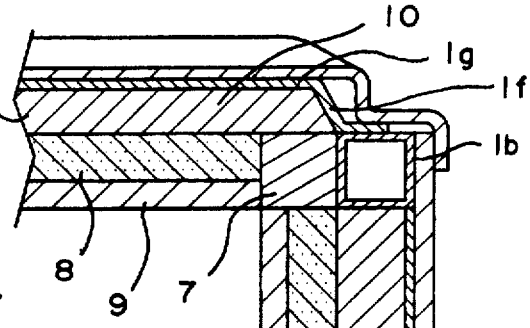
FIG. 6 is a view taken along line 6—6 of FIG. 3.

Referring to FIGS. 2, 6, and 9, the roof of the building includes transversely extending wood strips 6 contained within and secured to the container roof reinforcing bosses 1*g*. Each of the ends of the wood strips 6 are supported on longitudinally extending wood corner strips 7 secured to the longitudinally extending tubular members 1*b* of the shipping container. An insulation layer 8 is secured to the wood strips 6, and an inside covering 9 is applied to the insulation layer 8 to thereby provide the ceiling for the building.

Instead of employing a truss roof, as disclosed in the above-mentioned patent, the exterior of the roof if is provided with a plastic roof cap 10 molded to conform to the configuration of the roof 1*f* of the container.

Figure 3:
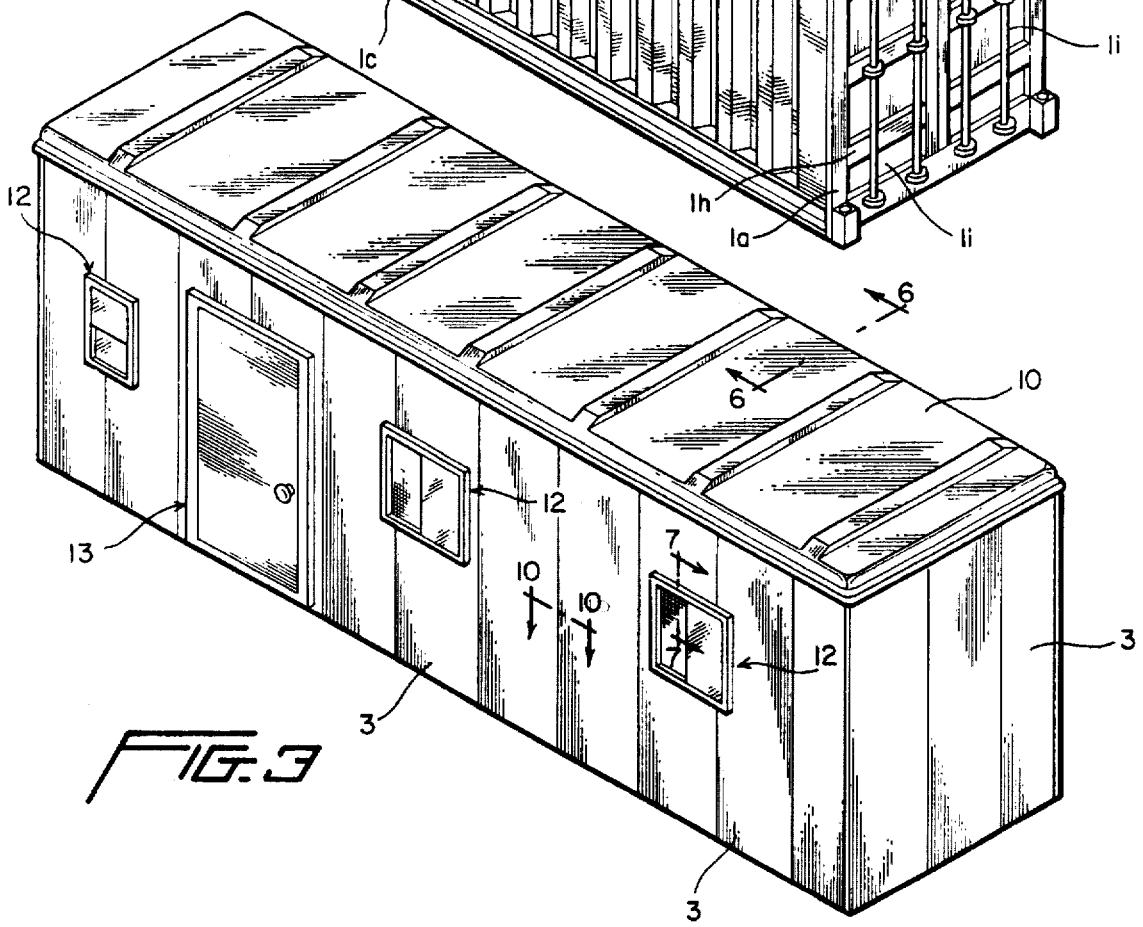
FIG. 3 is a perspective view of the finished modular building.
Figure 7:
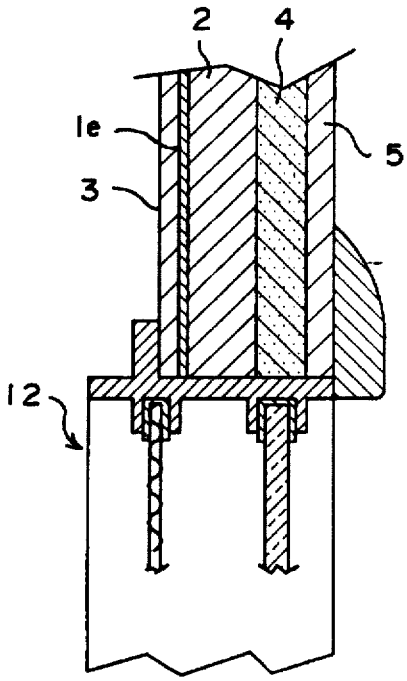
FIG. 7 is a view taken along line 7—7 of FIG. 3.

As will be seen in FIG. 2, suitable openings 11 are cut in a side wall 1*e* of the container adapted to receive prefabricated windows 12 as shown in FIGS. 3 and 7 and a prefabricated door 13, shown in FIG. 3.

Figure 8:
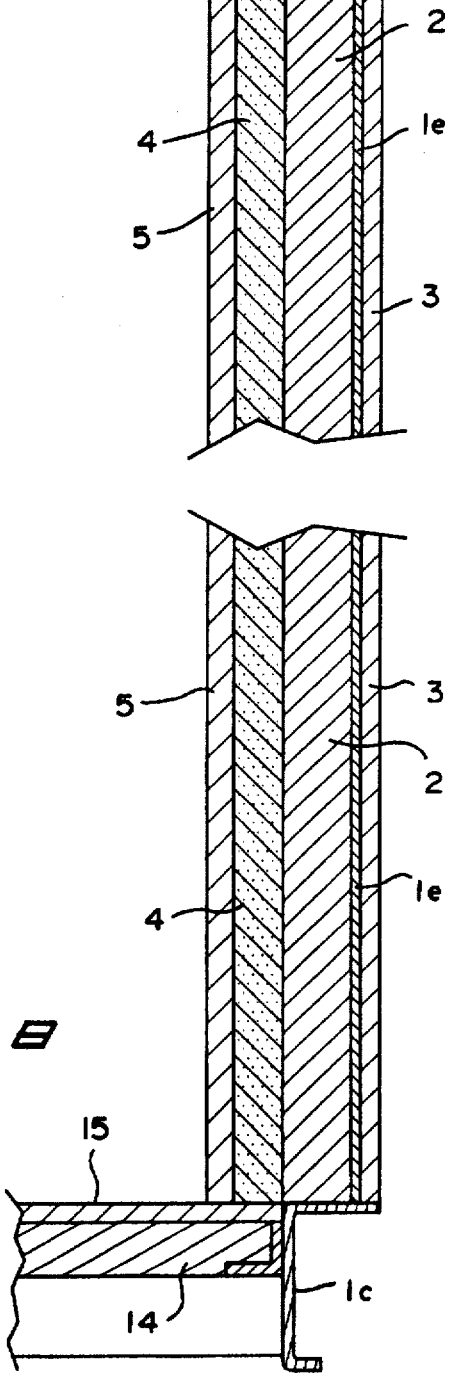
FIG. 8 is a fragmentary, sectional view of the lower wall portion and bottom or floor of the building.

The floor of the building is shown in FIG. 8 wherein the container floor 14 provides a subfloor for a finished flooring 15.

As will be seen in FIGS. 4, 5, 9, and 11, the interior of the building can be divided into various rooms by headers 16 and wall studs 17 to which inside walls 18 are secured. After the interior work is finished, including the installation of the kitchen appliances 19 and bathroom fixtures 20, the container hinged doors 1*i* are closed and welded shut. The container end walls are then covered with an outside covering and, on the inside, with a laminate insulation layer and inside wall covering. The finished building as shown in FIG. 3 can then be transported to a building site.

From the above description, it will be readily apparent to those skilled in the art that the modular building having a steel shipping container core of the present invention is relatively inexpensive, and, by positioning the wall wooden strips 2 in the interior grooves of the corrugated side walls 1*e*, and transversely extending wooden strips 6 in the roof bosses 1*g*, the interior dimensions of the building are not compromised, and, by adhesively securing the insulation layers 4 and 8 to the strips 2 and 6, and the outside covering 3 to the outwardly facing peaks 3*a* of the corrugation side walls 1*e*, the use of mechanical fasteners is precluded to thereby maintain the insulating integrity of the building.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

I claim:

1. A modular building having a steel shipping container core comprising, a steel shipping container having corrugated side walls, said corrugated side walls having alternating inside facing grooves and outside facing grooves formed by alternating inside facing peaks and outside facing peaks, a plurality of vertically extending strips mounted in said inwardly facing grooves, an inner wall, means for securing said inner wall to said strips and to the inner facing peaks, a roof, a plurality of transversely extending reinforcing bosses in said roof, each boss having a recess facing the interior of the container, a transversely extending strip mounted in each recess, a ceiling, means for securing said ceiling to the transversely extending strips, and a roof cap having a configuration corresponding to the exterior surface of the roof being mounted on said roof.

2. A modular building according to claim 1, wherein the inner wall comprises a laminate structure of an insulating layer and an inner wall covering.

3. A modular building according to claim 2, including an outer wall covering and means for fastening the outer wall covering to the outside facing peaks.

4. A modular building according to claim 3 wherein the means for fastening the inner wall to the strips and to the inner facing peaks, and the outer wall covering to the outside facing peaks comprises adhesive.

5. A modular building according to claim 1, wherein the ceiling comprises a laminate structure of insulation and an inside wall covering.

6. A modular building according to claim 1, wherein the means for securing the ceiling to the transversely extending strips comprises an adhesive.

7. A modular building according to claim 1, wherein openings are cut in a side wall of said container, prefabricated windows and a door mounted in a respective opening.

8. A modular building according to claim 1, wherein the container has a floor, a finished flooring mounted on said container floor, whereby the container floor provides a subflooring for the finished flooring.

* * * * *